US008511686B2

(12) United States Patent
Davis et al.

(10) Patent No.: US 8,511,686 B2
(45) Date of Patent: Aug. 20, 2013

(54) GAME BOARD

(76) Inventors: Delroy Davis, Catonsville, MD (US); Barbara Davis, Catonsville, MD (US)

( * ) Notice: Subject to any disclaimer, the term of this patent is extended or adjusted under 35 U.S.C. 154(b) by 0 days.

(21) Appl. No.: 12/826,563

(22) Filed: Jun. 29, 2010

(65) Prior Publication Data

US 2011/0001289 A1 Jan. 6, 2011

Related U.S. Application Data

(63) Continuation-in-part of application No. 11/269,206, filed on Nov. 7, 2005, now Pat. No. 7,784,792.

(51) Int. Cl.
*A63F 3/00* (2006.01)

(52) U.S. Cl.
USPC ..... 273/281; 273/287

(58) Field of Classification Search
USPC ..... 273/281, 287
See application file for complete search history.

(56) References Cited

U.S. PATENT DOCUMENTS

| | | | | | |
|---|---|---|---|---|---|
| 186,020 | A | * | 1/1877 | Ryan | 108/10 |
| 462,933 | A | * | 11/1891 | Sanderson | 108/26 |
| 614,722 | A | * | 11/1898 | Issacs | 312/227 |
| 687,487 | A | * | 11/1901 | Powell | 273/281 |
| 1,752,251 | A | * | 3/1930 | Giroux | 40/447 |
| 2,476,580 | A | * | 7/1949 | Bergman | 434/206 |
| 2,522,202 | A | * | 9/1950 | Theis | 108/70 |
| 3,001,843 | A | * | 9/1961 | Davis | 108/62 |
| 3,871,655 | A | * | 3/1975 | Zimmers et al. | 273/123 R |
| 4,134,592 | A | * | 1/1979 | Pullman | 273/281 |
| 5,752,886 | A | * | 5/1998 | Tien | 473/14 |
| 6,419,224 | B1 | * | 7/2002 | Tsai | 273/108.1 |

* cited by examiner

*Primary Examiner* — Vishu K. Mendiratta

(57) ABSTRACT

A gaming apparatus including a top surface and four side walls connected each other and to the top, the top having a game surface such as a 64 block checkerboard pattern of a first and second color, the game surface having cutouts; eight rods running crossways under the top surface and attached to two side walls; multiple rollers accessible to a player through the cutouts in the top surface. Preferably the game surface is angled on two opposing sides of each cutout to aid in rotation of the rollers underneath the game surface. The game apparatus may be adopted to play checkers, chess, backgammon or similar games. The game apparatus may also be embedded into tables or walls.

5 Claims, 11 Drawing Sheets

GAME BOARD

PRIORITY INFORMATION

This application claims benefit to U.S. application Ser. No. 11/269,206 filed on Nov. 7, 2005 and this application is hereby incorporated by reference.

BACKGROUND OF THE INVENTION

1. Field of the Invention

The present invention relates to a gaming apparatus using integrated rollers for game pieces for use in connection in playing a game such as chess, checkers or backgammon or the like that moves game pieces along a pattern present on a game board. The gaming apparatus using integrated rollers for game pieces has particular utility in connection with an all-in-one game set.

2. Description of the Prior Art

The use of game boards with interconnected playing pieces is known in the prior art. For example, U.S. Pat. No. 5,096,203 to Elstein et al. discloses a board game having several rotatable drums that substitute for playing pieces with two color types. Elstein fails to disclose a roller that represents two game pieces on a single block.

U.S. Pat. No. 4,062,546 to McIntyre discloses a game board having windows and a dial operated by the player to indicate a playing piece at that location. McIntyre does not disclose a roller running crossway along the entire length of the board.

Similarly, U.S. Pat. No. 6,042,117 to O'Brien describes a game board with permanently attached game pieces that can indicate checkers. In this case the game pieces are a push button type and not a roller.

U.S. Pat. No. 4,546,981 to Elizondo describes a game board with rotatable strips. The entire strip can be rotated during play of the game to change the relationship of the playing pieces. Elizondo does not provide playing pieces are integral with the game board.

While the above-described devices fulfill their respective, particular objectives and requirements, the aforementioned patents do not describe a gaming apparatus using integrated rollers for game pieces that allows for simple manufacture of a game board with integrated playing pieces. The Elstein et al. patent makes no provision for more than one game piece on one block. The McIntyre patent makes no provision for game pieces on a roller. The O'Brien patent makes no provision for a roller that can indicate the position of playing pieces. The Elizondo patent makes no provision for playing pieces that are integral with the game board.

Therefore, a need exists for a new and improved gaming apparatus using integrated rollers for game pieces which can be used for playing a game such as chess, checkers or backgammon or the like without losing game pieces. In this regard, the present invention substantially fulfills this need. In this respect, the gaming apparatus using integrated rollers for game pieces according to the present invention substantially departs from the conventional concepts and designs of the prior art, and in doing so provides an apparatus primarily developed for the purpose of providing an all-in-one game set.

SUMMARY OF THE INVENTION

In view of the foregoing disadvantages inherent in the known types of game sets now present in the prior art, the present invention provides an improved gaming apparatus using integrated rollers for game pieces, and overcomes the above-mentioned disadvantages and drawbacks of the prior art. As such, the general purpose of the present invention, which will be described subsequently in greater detail, is to provide a new and improved gaming apparatus using integrated rollers for game pieces which has all the advantages of the prior art mentioned heretofore and many novel features that result in a gaming apparatus using integrated rollers for game pieces which is not anticipated, rendered obvious, suggested, or even implied by the prior art, either alone or in any combination thereof.

To attain this, the present invention essentially comprises a top and side walls connected to the top, the top having a game surface with cutouts in the game surface, the game apparatus also including rods running under the game surface and attached to at least one side walls with multisided rollers fitting on each of the rods. The rollers are accessible to a player through the cutouts in the game surface and the rollers including, on each side of the roller, different colors or shapes to represent different game pieces. The game apparatus may also include a stop material adjacent to each roller to interact with the roller and prevent the rollers from freely rotating.

In one version, the side of the top surface opposite the game surface is angled on two opposing sides of each cutout to aid in the movement of the rollers.

In another version, the game boards are integrated into a table top or a wall.

In yet another version, one or two rollers may be accessible to a player for the playing of any game such as checkers or chess.

In one version, the gaming apparatus including a plastic top surface and four side walls connected to the top, the top having a 64 block checkerboard pattern of a first and second color, the checkerboard having cutouts in the blocks of the first color of the checkerboard pattern; eight rods running crossways under the top surface and attached to two side walls; eight six sided rollers fitting on each of the eight rods, the rollers accessible to a player through the cutouts in the top surface, the rollers include on each side of the roller, color the same as the first color or the second color or the first or second color with the image of at least one game piece thereupon. Preferably a six sided roller is provided to represent either no game piece present, a first player's game piece present, a first player's kinged game piece present (two game pieces of the same color on the same block), a second player's game piece present, or a second player's kinged game piece present on that particular block of the checkerboard.

In another embodiment, a game apparatus including a plastic top surface and four side walls connected to the top, the top having a 64 block checkerboard pattern of a first and second color, the checkerboard having cutouts in each of the blocks of the checkerboard pattern; eight rods running crossways under the top surface and attached to two side walls; sixteen eight sided rollers fitting on the rods, two rollers accessible to a player through each cutout block in the top surface, one roller having the images of chess pieces in a first chess piece color and a second roller having the images of chess pieces in a second chess piece color.

In yet another embodiment, a game apparatus including two rectangular halves, each halve containing twelve play sections, each play section including eight cutouts, where one half additionally includes counter; a center piece include at the center rollers on a rod; hinges connecting the two halves to the center pieces at opposite ends of the center piece rods running crossways under the top surface of each halve; multisided rollers fitting on the rods, the rollers accessible to a player through the cutouts in the top surface.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gaming apparatus using integrated rollers for game pieces that has all of the advantages of the prior art game sets and none of the disadvantages.

It is another object of the present invention to provide a new and improved gaming apparatus using integrated rollers for game pieces that may be easily and efficiently manufactured and marketed.

An even further object of the present invention is to provide a new and improved gaming apparatus using integrated rollers for game pieces that has a low cost of manufacture with regard to both materials and labor, and which accordingly is then susceptible of low prices of sale to the consuming public, thereby making such gaming apparatus using integrated rollers for game pieces economically available to the buying public.

Still another object of the present invention is to provide a new gaming apparatus using integrated rollers for game pieces that provides in the apparatuses and methods of the prior art some of the advantages thereof, while simultaneously overcoming some of the disadvantages normally associated therewith.

Even still another object of the present invention is to provide a gaming apparatus using integrated rollers for game pieces that provides a travel toy or safety toy for children because the game pieces of the present invention cannot be lost or swallowed.

Still yet another object of the present invention is to provide a gaming apparatus using integrated rollers for game pieces where game pieces cannot be lost.

In yet another object of the present invention is to provide a gaming apparatus using integrated rollers for game pieces that can be wet or be exposed to elements.

It is also an object of the present invention to provide table tops or walls with the game boards of the present invention embedded therein.

It is also an object of the present invention to angle the side of the top surface opposite the game surface at the cutout edges to aid in roller movement.

Lastly, it is an object of the present invention to provide a new and improved game that can be played in awkward places or positions or unstable surfaces without fear of pieces falling off or getting lost.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
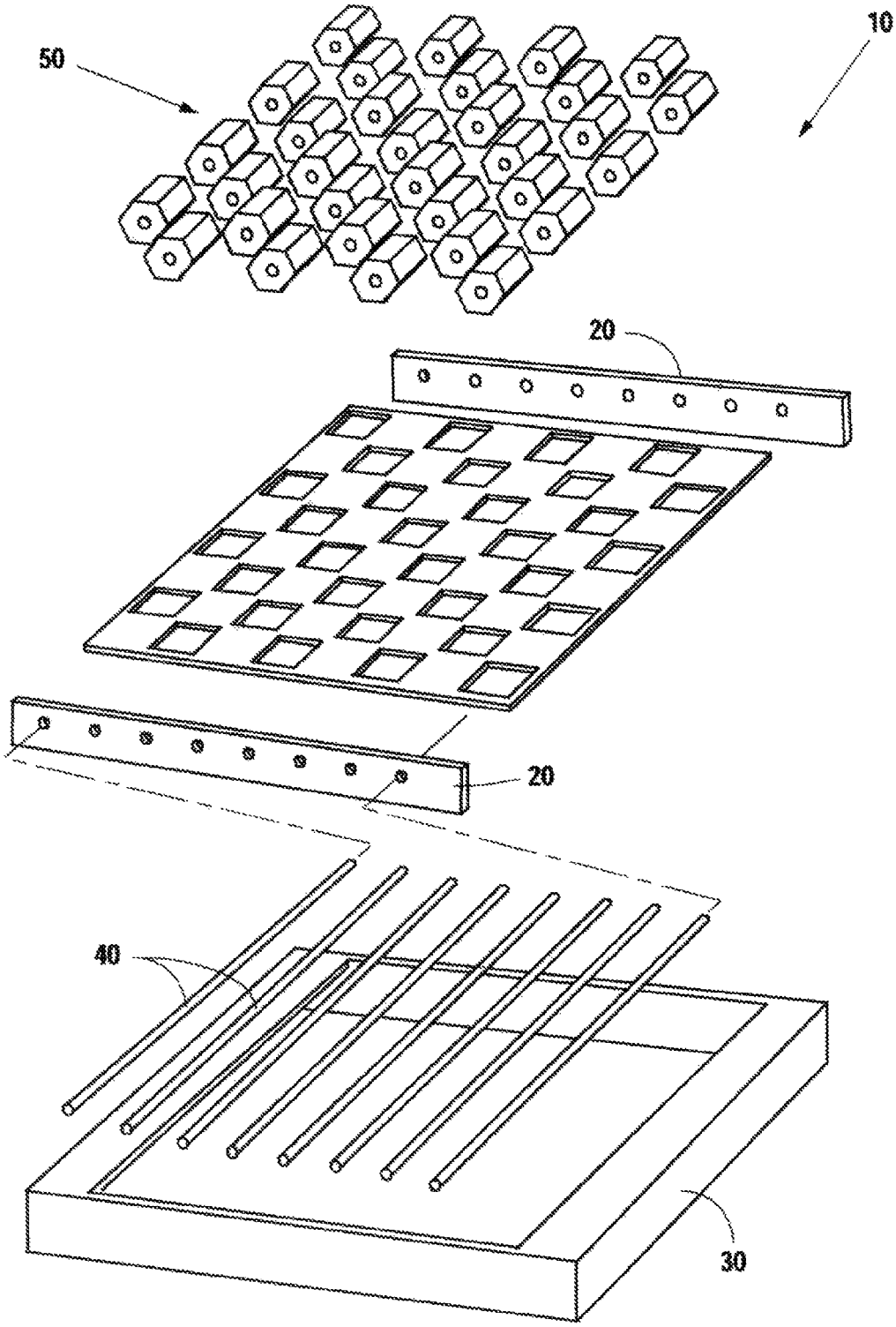
FIG. 1 is an exploded view of one preferred embodiment of the gaming apparatus using integrated rollers for game pieces constructed in accordance with the principles of the present invention for playing checkers.
Figure 2:
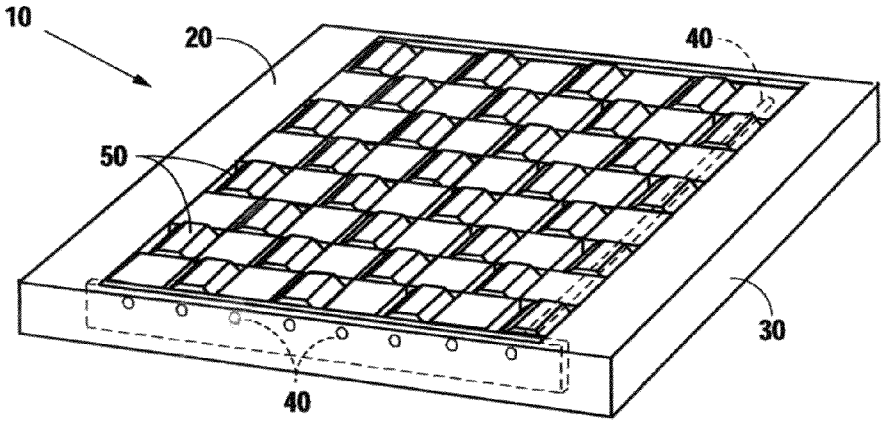
FIG. 2 is a perspective view of one preferred embodiment of the gaming apparatus using integrated rollers for game pieces constructed in accordance with the principles of the present invention for playing checkers.
Figure 3:
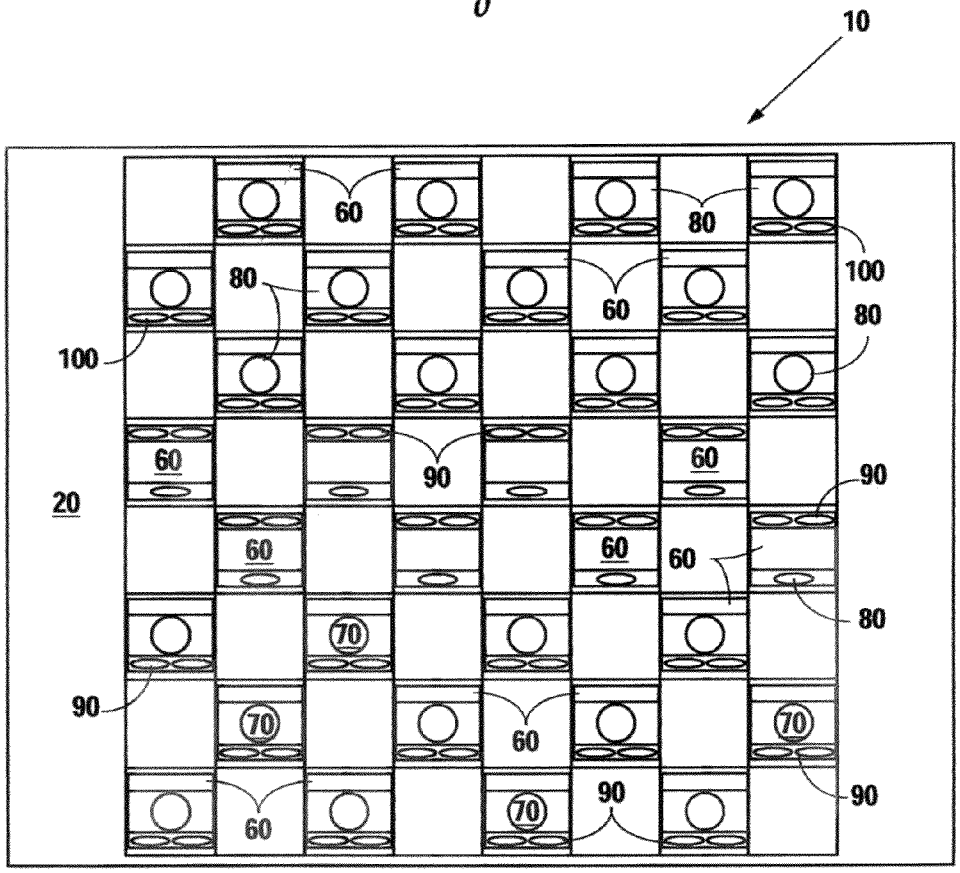
FIG. 3 is a top view of one preferred embodiment of the gaming apparatus using integrated rollers for game pieces constructed in accordance with the principles of the present invention for playing checkers.

Referring now to the drawings, and particularly to FIGS. 1-3, a preferred embodiment of the gaming apparatus using integrated rollers for game pieces of the present invention for playing checkers is shown and generally designated by the reference numeral 10.

In FIG. 1, a new and improved gaming apparatus using integrated rollers for game pieces 10 of the present invention for providing a game board with integrated playing pieces is illustrated and will be described. The game apparatus 10 includes a top 20 that has a game surface such as a 64 block checkerboard pattern. The game apparatus includes four side walls, each connected to the top surface. Three side walls 30 are shown in FIG. 1. The game apparatus include eight rods 40 that run crossways under the top surface. Multisided rollers are fitted onto the rods, not shown in FIG. 1. Preferably the multisided rollers are six-sided rollers. In FIG. 1, the black blocks of the checkerboard are cutout to provide the player access to the rollers placed on the rods 40 below the top 20. In particular, when looking at a black block of the checkerboard pattern, a section of the black block is cutout, leaving a portion of the black blocks remaining and a portion of the black blocks cutout. Cutout lines 50 can be seen on the black blocks in FIG. 1. Color is provided on the rollers located on the rods 40 below the playing surface 20 to make the black blocks appear either all black or black with a white oblong playing piece thereupon or the like.

FIG. 2 shows a perspective view of the game apparatus 10 of the present invention fully assembled. The four side walls 30 are connected to the top surface game board 20 and to each other at the corners. The rods 40 with six sided rollers fitted thereupon are located within the game board.

A preferable embodiment of the present invention is shown in FIG. 3. Most preferably, the present invention is formed as follows. A 12"×16" hard plastic top with 64 block Checkerboard pattern on top with the black portion of the checkerboard including cutouts, which sits on top of two (2) 1"×16" and two (2) 1"×12" sides. Eight (8) ¼" plastic rods are attached to the 1"×16" side walls and running crossways along each of the 8 rows of the checker board each having Four (4) of 32 six (6) sided rollers. The rollers are accessed through the cutouts in the board top such as by the thumb or finger of a player. Each roller has two (2) black sides, one (1) black side with 1 white oblong, one (1) black side with two white oblongs, and one (1) white side with 1 black oblong and one (1) white side with two black oblongs. The game is played similar to checkers with the rollers marked with oblongs filling in as game pieces. In this case the sides of the rollers with two oblongs would represent a kinged game piece. Preferably two oblongs are placed side by side on a single side of the roller. However, other versions of game pieces on a background color are also encompassed by the present invention. FIG. 3 shows the rollers of the gaming apparatus of the present invention in various stages to permit viewing of the six sides of the roller. Namely black sides 60, a black side with one (1) white oblong 70, one white side with one black oblong thereupon 80, a black side with two (2) white oblongs thereupon 90 is partially shown in FIG. 3, and a white side with two (2) black oblongs thereupon 100 is partially shown in FIG. 3.

In use it can now be understood that a game of checkers may be played with gaming apparatus of the present invention. In particular, two players would each select a different color and start at opposite ends of the checkerboard. The game would be played following conventional rules for checkers, however, instead of moving game pieces over a checkerboard, the player would use a finger or thumb to change the rollers from the cutout portions in the board to find the appropriate game piece, including a game piece of the players own color, a game piece of the player's opponent, a double game piece (a king) in either the player's color or the opponent's color. The player (game board user) does not have to worry about losing game pieces during play or losing the position of the game pieces upon the board. This provides the player the advantage of playing the game in a variety of locations or positions. It can not also be understood that the gaming apparatus, while shown with a conventional checkers setup, may be applied to any similar game with ease. Such a development makes games easy to manufacture, safe because small pieces cannot become loose and therefore lost or a choking danger to small children or pets, and a very convenient travel, car or boat game.

The top 20 includes a game surface that includes a checkerboard pattern. The game surface is the portion of the top that the player sees when playing with the game apparatus. More preferably the game surface of the top includes a 64 block checkerboard with alternating blocks of two colors. The top 20 preferably is made of plastic, preferably a firm and hard plastic. The top 20 may contain a border around the checker board pattern. The border may be of any width and include any pattern. The top 20 may include writing on the surface around the checkerboard pattern. The checkerboard may contain more or less than 64 blocks, may contain a different type of pattern, diamonds for example. Preferably, the top 20 is twelve inches by sixteen inches but the dimensions may be varied for the convenience of the user.

The side walls 30 may be of two different lengths to form a generally rectangular game board. The four side walls 30 may be of the same length to make a generally square game board. Preferably the depth of each side wall is about one inch. However, the depth may be varied if desired. More preferably the game apparatus uses four side walls, two side walls are one inch by sixteen inches and two side walls are one inches by twelve inches length.

In construction, two side walls are formed with 8 holes of a size appropriate to accommodate the eight rods of the present invention. Preferably the rods are made of plastic and are one-fourth inch thickness. The two side walls 30 that connect to the rods 40 of the present invention may be made of a single piece or the portion of the side wall that fits the rods may be made separately and connected to other pieces to form the above described side walls.

The game apparatus may be left open at the bottom or may be fitted with a bottom of comparable size to the top to meet the four side walls and to enclose the game apparatus.

The game pieces imprinted on the game board rollers may be made by any appropriate manner. The game pieces may be stickers placed on the roller in a semi-permanent or permanent manner. The game pieces may be applied in the manufacturing process with a permanent ink. The roller may be made of two colors in the manufacturing process to make an integrated piece of a background color and game piece represented thereupon. The rollers may be molded with game pieces thereupon. The game pieces may be any appropriate shape or color. The game pieces may have any appropriate image, icon, wording or trademark placed thereupon. The rollers may be made of any material that will make a multi-sided roller. The roller must be hollow in the center to fit upon the rod. The roller may have as many sides as need to represent all of the game pieces necessary to play a particular game.

The rods that run crossways under the top may be supported by supports as needed. The supports may be attached to the underside of the top on the side opposite the playing surface, that is, underneath the top surface. The supports may also be secured to any of the side walls or a bottom. The supports may be placed as needed to support the rod/roller combination. There may be one, two or more as needed for proper working of the rod/roller combination. Supports are also described below.

The game apparatus of the present invention for playing checkers may also include a stop material to prevent the roller from freely rotating so that when a player has reached the desired game piece in view, the roller will stop. Of course, it is also desired that when the player wants to change the game piece, the piece may be moved easily and firmly to another game piece position. It is also desirable to provide a system that is very durable and will not wear out with repeated use. To this end, in a preferred embodiment that stop material is preferably the receptive portion of a hook and loop type interlocking material. Most preferably the softer side of a Velcro™ is used. In one embodiment, an adhesive backed Velcro™ is used to as stop material and is placed adjacent to the rollers. The stop may be placed adjacent to the rollers by a rod or strip that runs crossways under the game surface and parallel to the rods supporting the rollers. When assembled in this manner, the Velcro™ works much like the brake on a car, preventing free movement of the roller but also providing the ability to move the roller to a desired location. Other systems or methods to frictionally interact with the rollers so as to prevent the rollers from freely rotating are also encompassed by the present invention.

Figure 4:
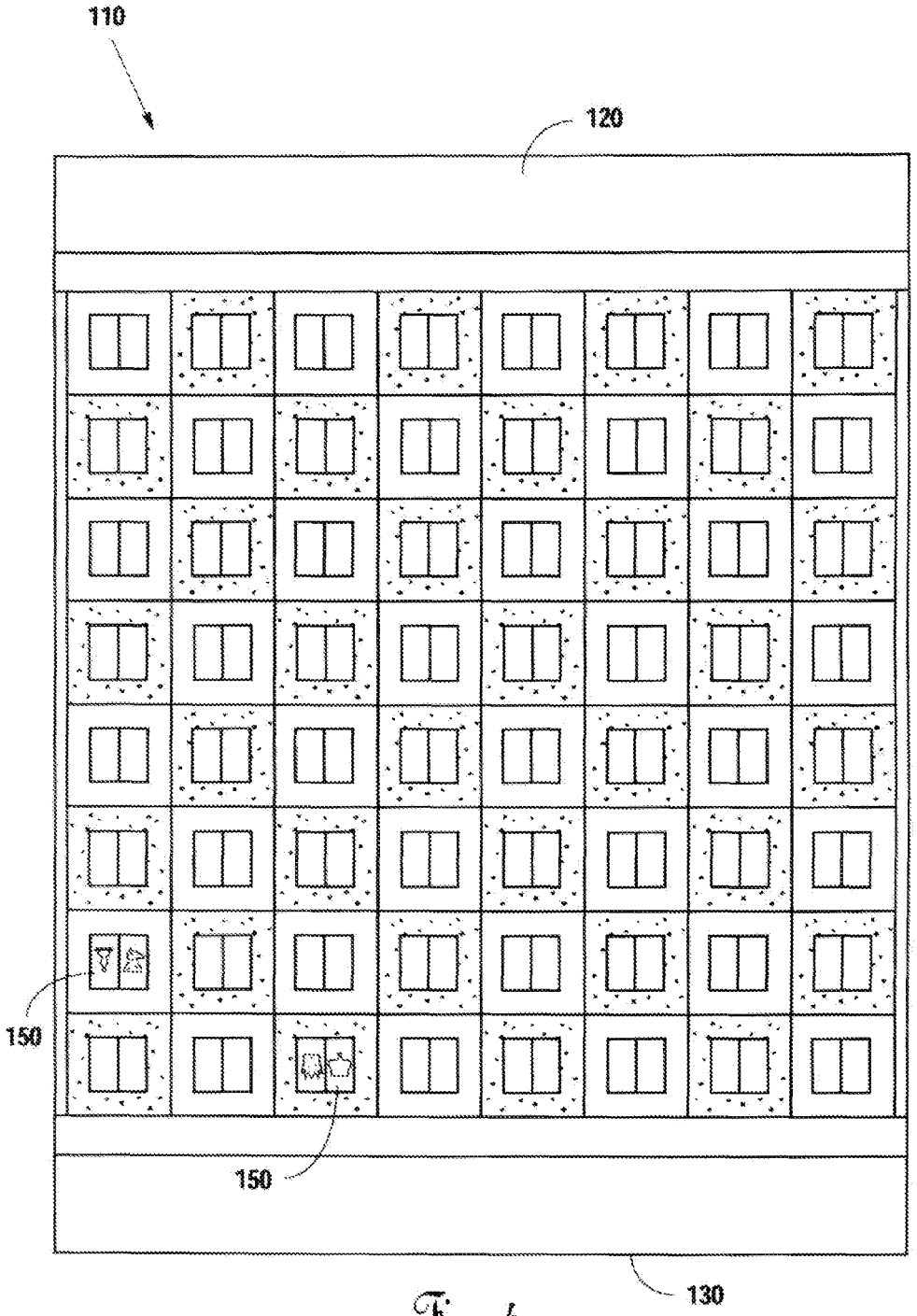
FIG. 4 is a top view of another embodiment of the gaming apparatus using integrated rollers for game pieces constructed in accordance with the principles of the present invention for playing chess.
Figure 5:
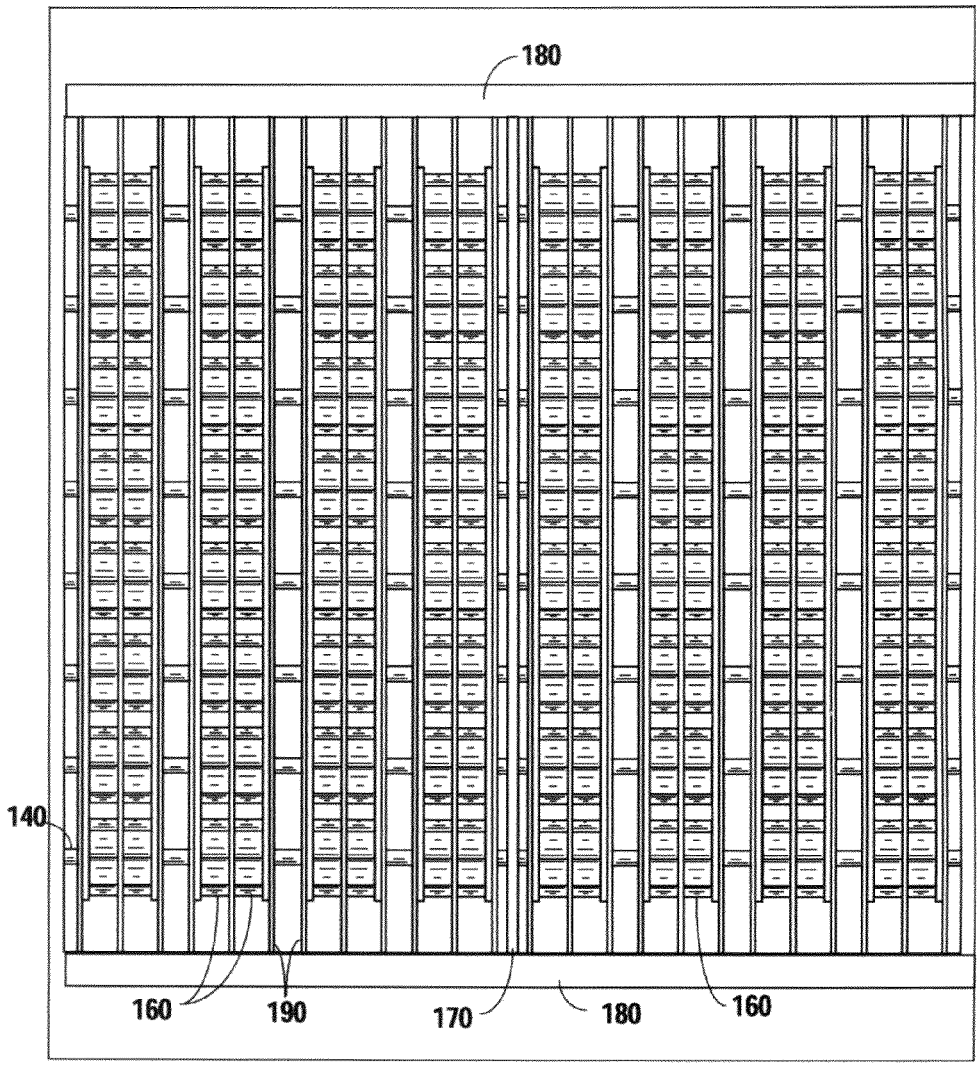
FIG. 5 is a bottom view of another embodiment of the gaming apparatus using integrated rollers for game pieces constructed in accordance with the principles of the present invention for playing chess.
Figure 6:
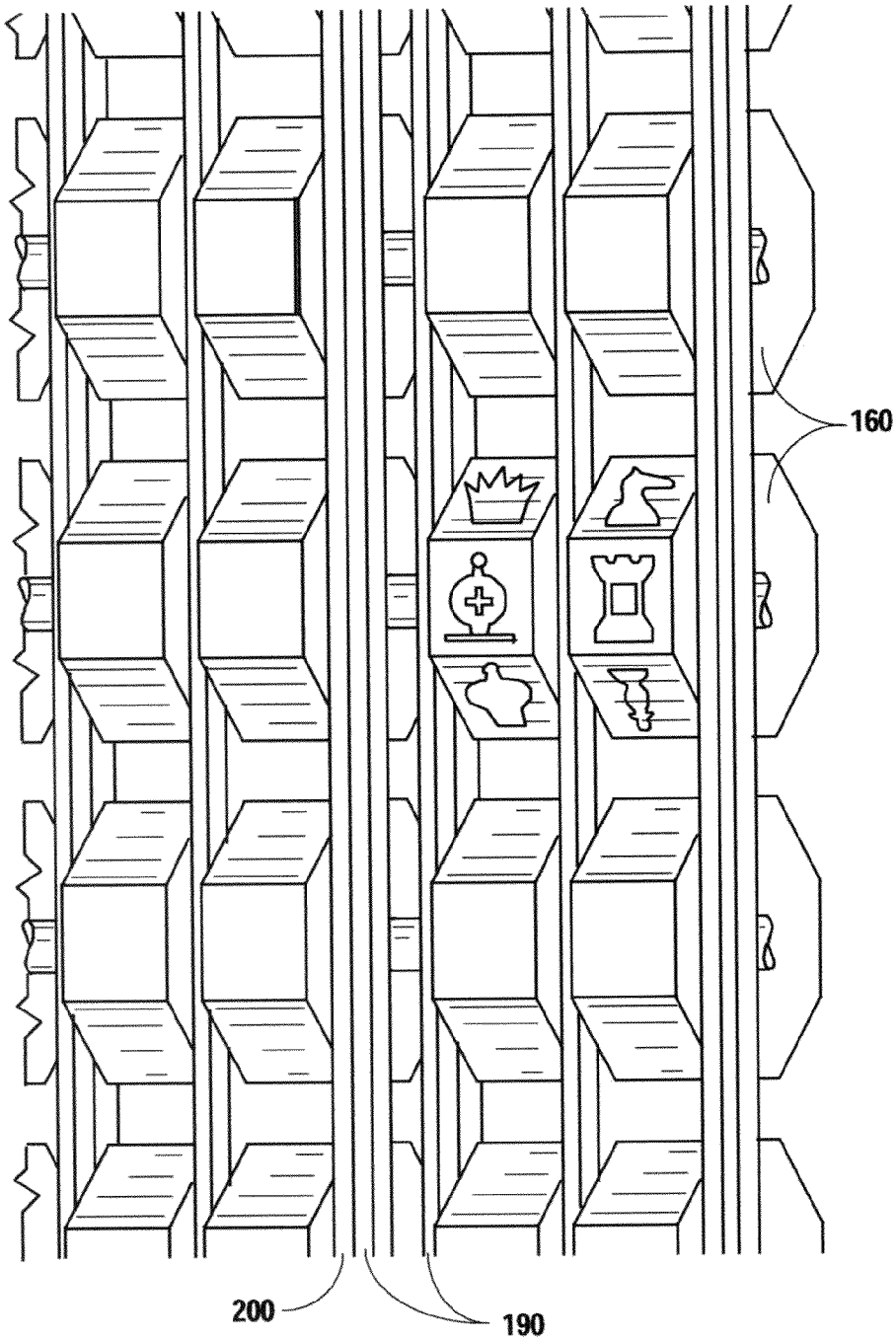
FIG. 6 is an exploded view of the bottom of another embodiment of the gaming apparatus using integrated rollers for game pieces constructed in accordance with the principles of the present invention for playing chess.

In another embodiment of the present invention, a chess board with integrated playing pieces is provided and will now be described in detail. A chess gaming apparatus with integrated game pieces is shown in FIGS. 4 through 6. A top view of the chess gaming apparatus with integrated game pieces is shown in FIG. 4 and is generally indicate 110. The chess gaming apparatus includes a top surface including a game board 120. Preferably the game board of the top includes a 64 block checkerboard pattern. In this case all 64 blocks of the checkerboard will contain a cutout similar to the checkerboard top. That is, a portion of each block of the pattern is cutout leaving a border of block remaining. Cutout lines 150 can be seen on the blocks in FIG. 4. The chess game apparatus includes four side walls 130, each connected to the top. As shown best in FIG. 5, where the chess gaming apparatus is viewed from the bottom, eight rods 140 run crossways under the top surface. Sixteen eight-sided rollers 160 are fitted onto the rods. The rollers 160 form eight pairs of rollers, one pair of two rollers 160 are accessible in each cutout block of the game surface. In FIG. 4, the blocks of the checkerboard are cutout to provide the player access to the rollers 160 placed on the rods 140 below the top 120. The player can rotate each roller using a fingertip touch. The rollers 160 each have an image of one of six chess pieces and two blank spaces on each of its eight sides. In the gaming apparatus shown in FIGS. 4-6, the game uses silver and gold for the color of the pieces. Although it is noted that any colors may be used. One of the two rollers in each cutout will be for silver and the other for gold. The rollers backgrounds, or blank spaces upon the rollers 160, will be black or white coordinating with their color on the checker board.

In yet another embodiment, a game board with two rollers in each cutout as shown and described above maybe used for playing checkers. In this case, two rollers are accessible to a player through each cutout on a checkerboard. The game board may be arranged for the playing of checkers, that is, a 64 checkerboard game surface of alternating colors is used. However only one color, that is, half of the checkerboard squares will include a cutout. One roller for each cutout would include indicia that would substitute for playing pieces of one color. The second roller in each cutout would include indicia that would substitute for playing pieces of second color, to indicate an opposing player. To play checkers, only three indicia per color would be needed: vacant, or no playing piece, a playing piece present in a square, or a "kinged" playing piece present in a square. The kinged playing piece is typically indicated as a double piece. Therefore at a minimum three sided rollers would be needed to indicate one of three indicia at each square for the playing pieces of a player. Both of the rollers in each cutout would have the same indicia, but in opposite colors to indicate two opposing players. For convenience six sided rollers may be used with each of the three variations indicated twice. The present invention would or course also encompass any side multisided roller the user desired. Such a game board with two rollers in each cutout accessible to a player could be constructed of similar materials and with similar construction as described above, including but not limited to four side walls, each connected to a top surface that includes the checkerboard described above, rods that run crossways under the top surface upon which the rollers described above may be fitted, a stop material to prevent the roller from freely rotating so that when a player has reached the desired game piece in view, the roller will stop.

Therefore, a game apparatus has been described that has a game surface of 64 block checkerboard pattern, with half of the blocks having cutouts. Four sides connect to each other and to the top surface. Eight rods run crossways under the game surface and three or six side rollers fit upon the rods so that two rollers are accessible to a player in each cutout. There would be sixteen rollers per rod. One roller in each cutout would have the images of checker pieces in a first color and a second roller in each cutout would have the images of checker pieces in a second color. The indicia would be the same on each roller, just in opposing colors.

Referring now to FIGS. 5 and 6, a support and control system for movement of the rollers 160 will be described. It is noted that the support and control system described for the chess gaming apparatus of FIGS. 5 and 6 is preferably also applied to any gaming apparatus if the present invention. In FIG. 5, a center support brace 170 is added to the middle of the board to support the eight rods 140 that run crossways underneath and across the playing surface. The center support brace 170 is secured at each end to an end brace 180 that runs parallel to the rods 140 and is secured to two side walls with liquid cement or the like. It is preferred that the rollers 160 do not rotate freely but only rotate when a player applies pressure to the roller 160 with a fingertip from the top 120 of the gaming apparatus and more preferably the roller 160 is easily stopped when the roller 160 reaches the position desired by the player. To meet this need, the gaming apparatus is additionally provided with strips 190 adjacent to each roller 160. The strips 190 are the same length as the center support brace 170 are also connected to each end brace 180. In the chess gaming apparatus, 24 strips are provided. The strips 190 are also provided with a stop material 200 at each point of contact between the outer surface of the roller and the plastic strip 190. That is each plastic strip adjacent to the outer surface of a roller will have eight stop materials 200. The placement of the stop material 200 at the point of contact with the outer edge of the roller but not in between the two adjacent rollers permits each roller of a pair to move independently of each other. The game apparatus may also include any variation of a stop material that is placed adjacent to each roller to interact with the multisided roller and prevent the rollers from freely rotating. The stop material adjacent to the rollers may interact with the roller due to friction between the stop material and multisided roller. The stop material may be placed adjacent to the rollers by any convenient means, for example the strips mentioned above, or individually placed stop materials at each roller site or on a rod running parallel to and adjacent to the rods supporting the rollers. It is appreciated that the stop material may be any material that can interact with the roller and prohibit free rotation of that roller. The stop material however, should be able to be moved with the pressure applied by a person's finger or thumb to the roller. That is, the interaction between the stop material and the roller needs to be secure, but not so secure that the positions of the roller cannot be changed. Further, it is appreciated that any means in addition to or in substitution of the plastic strip described above can be used to place the stop material and the roller in close contact. For example an elongated U-shaped piece of plastic that can be secured to the end brace or top at each end, the plastic having with extensions that correspond to each roller, the stop material placed on each extension is encompassed by the present invention. This would look much like a comb with several missing teeth, that is each end would provide an extension to be secured to side walls, a long straight piece would span the game board and the teeth would be extensions including a stop material would extend adjacent to the rollers.

With respect to the braces of the support and control system described above, it is noted that more than one brace can be provided as needed to support the rods of the gaming apparatus. More braces may be needed depending upon the weight of the rollers used. In the figures, the center support brace is shown attached to two end braces, each of which is attached to the same two walls that receive the eight rods. It is noted that the end braces may be replaced and/or be the same piece as the other two walls of the gaming apparatus. The center and end braces may be made of any appropriate material to support the rods with rollers thereupon. Preferably the braces are made of a very sturdy plastic. This preference will make the gaming apparatus lightweight and durable and inexpensive to manufacture. Preferably the center and end braces are machined to be one eighth inch thickness, although the thickness may be varied. The center and end braces may be secured to each other with liquid cement or other strong adhesive or manufactured as a single piece. As shown in the Figures, strips are provided adjacent to each roller on each side of the roller. The end braces may be machined to provide a slot to accommodate the strips and once placed into end brace, the strips may be glued using any adhesive or liquid cement to the end brace. Other embodiments of the strips are also encompassed by the present invention. For example, the strips may be replaced with another type of plastic or a fiberglass material additional the strips or equivalent material can be glued flush with each end brace, similar to the center support brace. The thickness of the strips may be varied as needed. As an alternative, the game board can be provided with a support across the center of game board surface and the rods containing the multisided rollers may span the length from one wall to the center support.

As shown in FIG. 6, each plastic strip that contacts the outer surface of a roller is provided with a stop material 200. The function of this stop material is to prevent the roller from freely rotating so that when a player has reached the desired game piece in view, the roller will stop. Of course, it is also desired that when the player wants to change the game piece, the piece may be moved easily and firmly to another game piece position. It is also desirable to provide a system that is very durable and will not wear out with repeated use. To this end, in a preferred embodiment that stop material is preferably the receptive portion of a hook and loop type interlocking material. Most preferably the softer side of a Velcro™ is used. In one embodiment, an adhesive backed Velcro™ is used to as stop material on the strips. When assembled in this manner, the Velcro™ works much like the brake on a car, preventing free movement of the roller but also providing the ability to move the roller to a desired location. Other systems or methods to frictionally interact with the rollers so as to prevent the rollers from freely rotating are also encompassed by the present invention.

A similar type of center support brace and end brace and strips adjacent to the rollers with stop material attached thereto as described above may be provided to the any gaming apparatus of the present invention.

As with the rollers of the checker game apparatus, the game pieces imprinted on the game board rollers may be made by any appropriate manner. The game pieces may be stickers placed on the roller in a semi-permanent or permanent manner. The game pieces may be applied in the manufacturing process with a permanent ink. The roller may be made of two colors in the manufacturing process to make an integrated piece of a background color and game piece represented thereupon. The rollers may be molded with game pieces thereupon. The game pieces may be any appropriate shape or color. The game pieces may have any appropriate image, icon, wording, logo, or trademark placed thereupon. The game piece rollers may be integral with the rods, one article of manufacture.

In use it can now be understood that a game of chess may be played with gaming apparatus of the present invention. In particular, two players would each select a different color and start at opposite ends of the board. The game would be played following conventional rules for chess, however, instead of moving game pieces over a chessboard, the player would use a finger or thumb to change the rollers under the cutout portions in the board to find the appropriate game piece, including a king, queen, knight, bishop, pawn, etc. of the players own color or of the player's opponent. The player (game board user) does not have to worry about losing game pieces during play or losing the position of the game pieces upon the board. This provides the player the advantage of playing the game in a variety of locations or positions.

It can not also be understood that the gaming apparatus, while shown with a conventional chess setup, may be applied to any similar game with ease. Such a development makes games easy to manufacture, safe because small pieces cannot become loose and therefore lost or a choking danger to small children or pets, and a very convenient travel, car or boat game.

Figure 7:
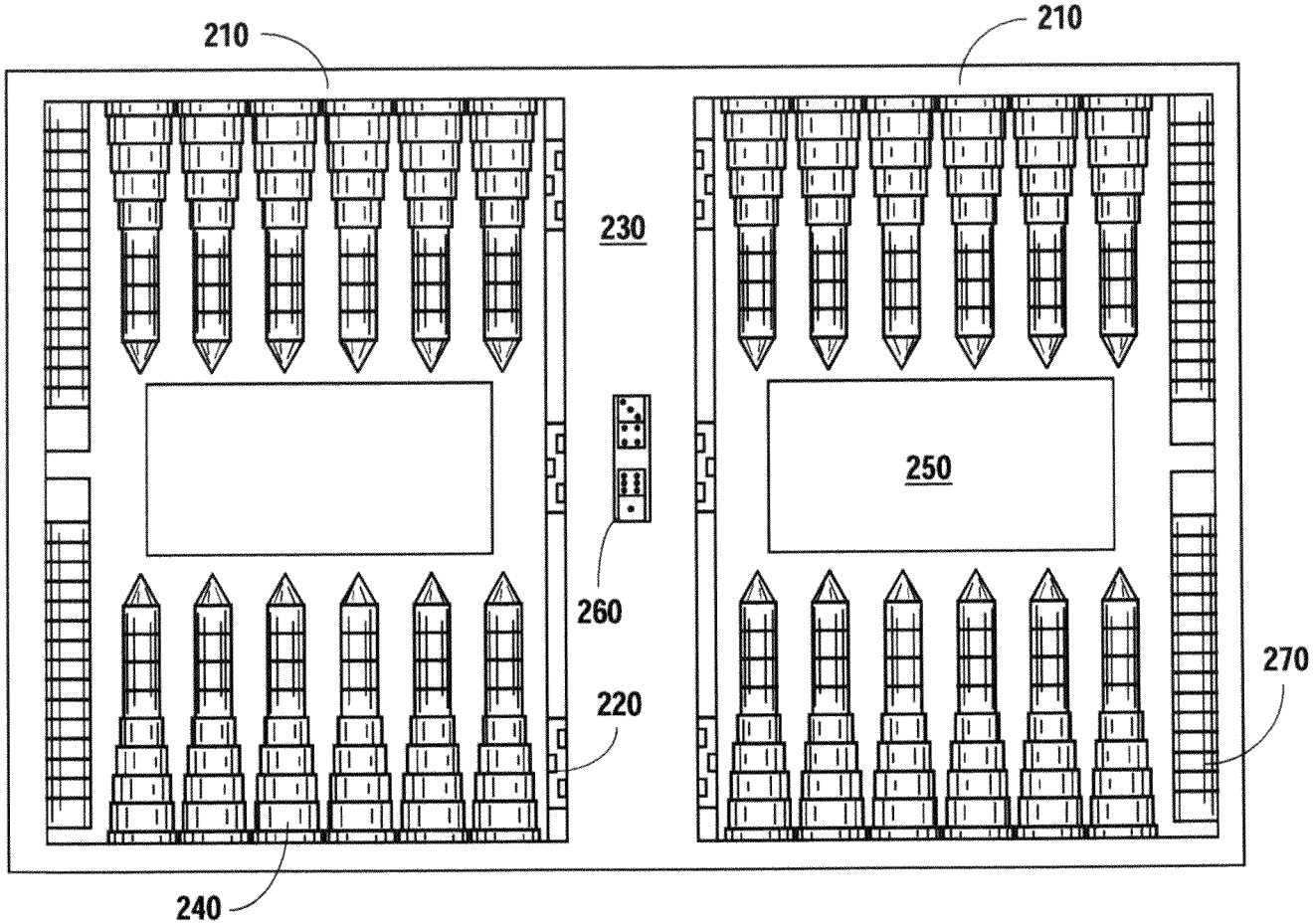
FIG. 7 is a top view of one preferred embodiment of the gaming apparatus using integrated rollers for game pieces constructed in accordance with the principles of the present invention for playing backgammon.
Figure 8:
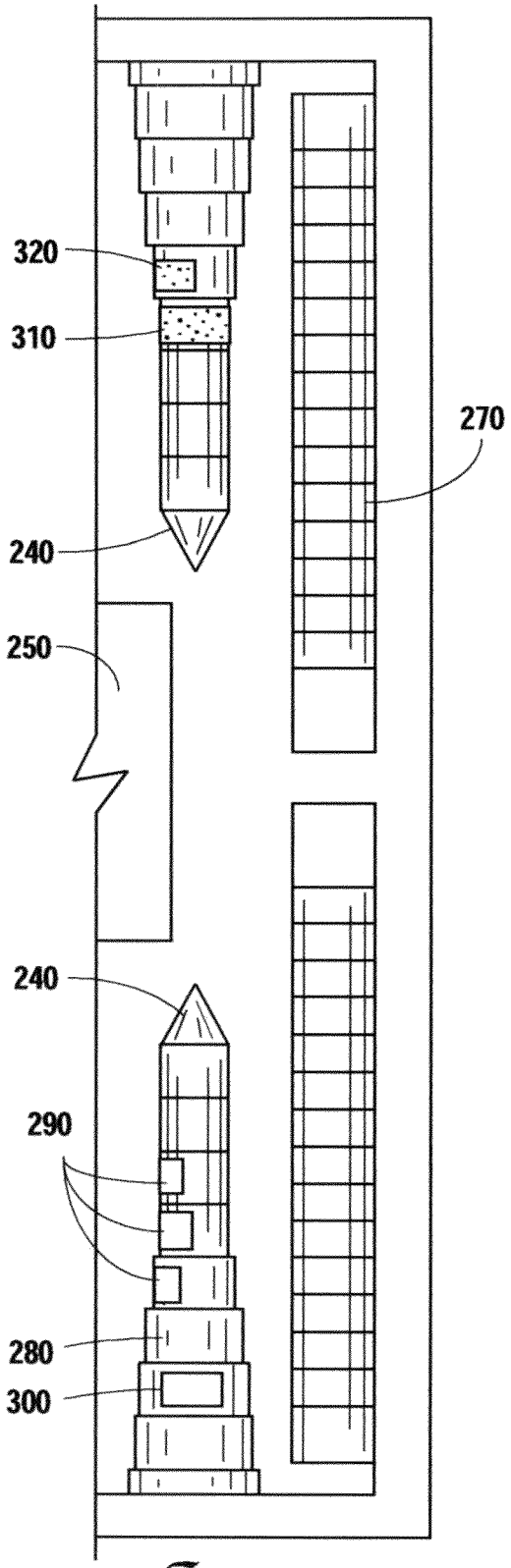
FIG. 8 is an exploded view of the top view of one preferred embodiment of the gaming apparatus using integrated rollers for game pieces constructed in accordance with the principles of the present invention for playing backgammon.

A backgammon board with integrated pieces is also encompassed by the present invention. FIGS. 7-8 show a backgammon type board with integrated game pieces. As shown in FIG. 7, the game board has two generally rectangular halves 210 hinged by at least one hinge 220 to a center piece 230 to permit the board to be closed when not in use or for travel. Each halve has, at opposite ends, six colored sections 240 for backgammon play, or play sections, for a total of twelve on each half. The center 250 of each half may include a recessed tray that may be used to roll die. Other variations for die enclosures are also encompassed by the present invention. In particular, that die may be enclosed in a bubble that the user shakes or "pops" upon their turn to "roll the die". Each play section of the game board includes cutouts. In a preferred embodiment, each play section includes 8 cutouts. The cutouts leave a colored border around the entire cutout. The play sections are of alternating colors. It is noted that the colors may be varied from those shown in the Figure. Under the game board are rods corresponding to the colored play sections of a backgammon board. The rods contain multisided rollers, similar to those of the checker and chess board. Each roller may includes sides that indicate, for example, two colors, one for each opposing game player and the color of the play sections of the backgammon board to indicate no piece in that position. The multisided rollers are accessible to a player from the top surface of the backgammon game board. In one preferred embodiment, each rod would contain multisided rollers to indicate game pieces on each play section. These rollers and rods are similar to those found under the checker and chess board. The rod may contain rollers for eight multisided rollers or sixteen. The rod may span the entire length under the top of the game board from one side to an opposite side. The rod may be supported with supports as necessary. Alternatively, the game board can be provided with a support across the center of each half and the rods containing the multisided rollers may span the length from one wall to the center support. The center piece 230 of the backgammon game board shown in FIG. 7 may also contain a roller 260 to indicate game pieces at that position. The roller 260 may be constructed in a manner similar to the other roller of the present invention. The game board additionally includes, at the end of one half of the game board a counter 270 to indicate pieces at the home position. It is appreciated that the center of each half of the game board may be modified to not include a recessed tray if desired. It is appreciated that the center piece may be of any desired width or may not be present at all. In FIG. 7, the multisided rollers are all positioned to the same background color as the play surface to indicate no game piece at this position. In the game board pictured in FIG. 7, white dice and blue dice are provided and as shown in FIG. 8, the multisided rollers are provided with blue sides and white side to indicate a variety of partially turned positions, from fully at the background color 280, to partially viewing a white sided roller 290, to a fully positioned white side of the roller 300, fully positioned blue sided of the roller 310, or partially positioned blue sided roller 320. It is appreciated that any colors can be used to formulate the game board, the play positions on the game board, the dice, and the game pieces. As described above, game pieces on the multisided rollers may be made by any appropriate manner. The game pieces may be stickers placed on the roller in a permanent manner. The game pieces may be applied in the manufacturing process with a permanent ink. The roller may be made of two colors in the manufacturing process to make an integrated piece of a background color and game piece represented thereupon. The rollers may be molded with game pieces thereupon. The game pieces may be any appropriate shape or color. The game pieces may have any appropriate image, icon, wording or trademark placed thereupon. As with the chess and checker game apparatuses described above, rods that run crossways under the top of the game board may be supported by supports as needed. The supports may be attached to the top on the side opposite the playing surface, that is, underneath the top surface of the game board. The supports may also be secured to any of the side walls or a bottom. The supports may be placed as needed to support the rod/roller combination. There may be one, two or more as needed for proper working of the rod/roller combination. As discussed with the chess and checkers game apparatuses, the game apparatus for backgammon may be supplied with a means to prevent free movement of the multisided game rollers, or a stop material. A stop material like that used for the checkers or chess game apparatus may be applied to the backgammon board of the present invention.

Figure 9:
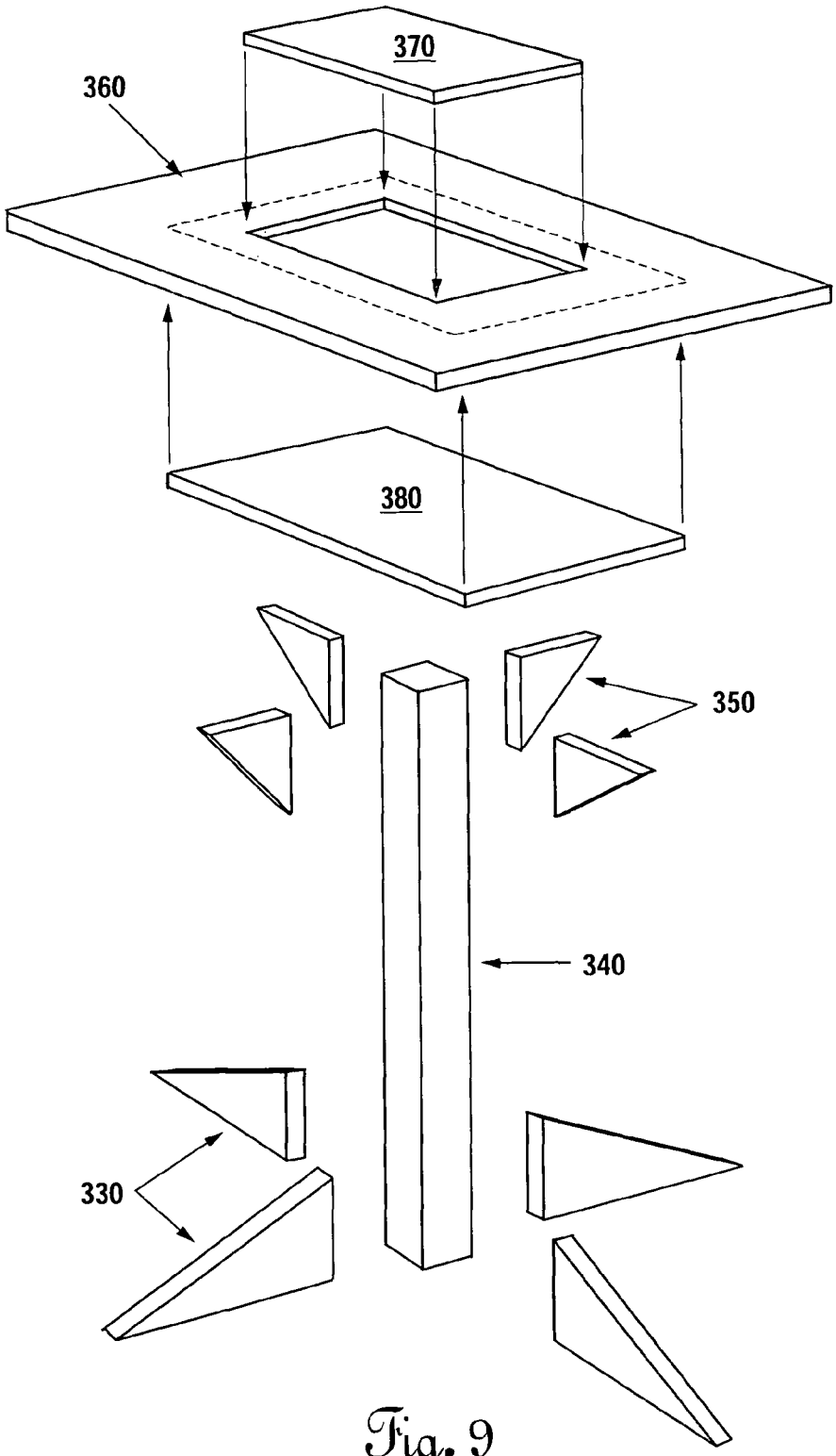
FIG. 9 is an exploded view of a table with a game board integrated therein.

The present invention also encompasses tables, wall or other permanent structures with any of the game boards of the present invention imbedded or enclosed therein. FIG. 9 shows an exploded view of an example table modified so as to fit a game board of the present invention. Four base pieces 330 are attached to a pedestal or an upright stand 340 at one end to form a bottom. Four support pieces 350 are attached to the opposite end of the upright stand 340 so as to support a table top 360. The table top 360 itself has a cut out for the game board. The game board 370 and table top are preferably of the same thickness, although they may be made of different materials or different thicknesses as needed for the user. Also included is an underneath support 380 to support the game board/table combination. The support 380 should be larger than the game board 370 but smaller or equal to the size of the table 360. The table 360 and support 380 may be made of any materials desired by the user. The dashed line on the table 360 demonstrates the area under the table covered by the support 380. It is understood that the size of the support and table in FIG. 9 are for illustrative purposes only and the present invention encompasses any size or shape of game board, table, support, upright stand, base pieces or support pieces that enclose, imbed or otherwise affix a game board of the present invention thereto. The game board may be permanently attached or embedded into the tables, wall or other permanent structures or may be removable so that different game boards may be inserted into the tables, wall or other permanent structures as desired by the user. The game board may be permanently attached or embedded into the tables, wall or other permanent structures with glue, nails, screws, tongue and groove fittings, drywall anchors, or any other means to enclose, affix, attach, embed or secure a game board to tables, wall or other permanent structures. The game board and tables, wall or other permanent structures may be a single article of manufacture so as to form a single unit. While a pedestal type table is shown in this Figure, it is understood and appreciated that any table base or support system can be used in conjunction with the game board/table invention described above. Tables with four legs, one at each corner, or a single stone pedestal or the like are also encompassed by the present invention. The phrase "table base" encompasses all of these variations or any other table bottom.

The game board apparatus or game board assembly is generally placed into the table as a unit, or game board unit. The game board unit is typically a fully assembled game board according to any of the embodiments of the present invention and would likely include: a top surface, side walls, rollers and rods, bottom cover. This unit would then be placed into the table top or wall or permanent structure as described above. It can also be appreciated that variations of the game board unit are also encompassed by the present invention, for example the bottom cover may be omitted if the game board will be covered on the bottom by the support 380. Alternatively the table top and top surface of the game may be a single article of manufacture and the side walls, rod and rollers added to the integral table/game surface.

Figure 10:
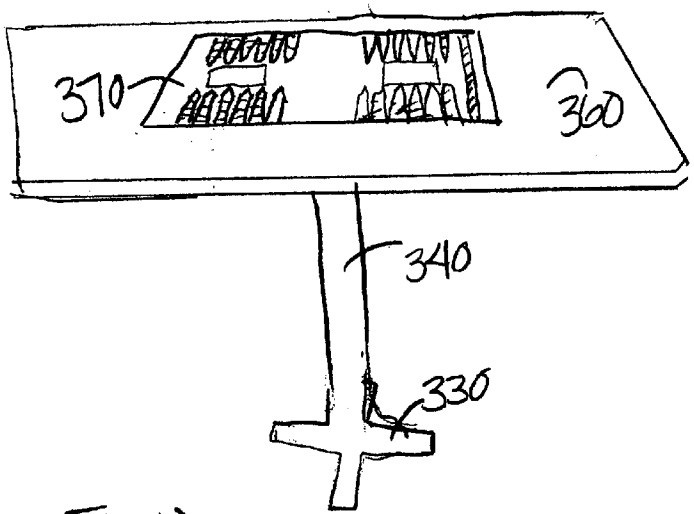
FIG. 10 is a table of game board/table of the present invention.

FIG. 10 shows a table of the present invention with four base pieces 330 are attached to an upright stand 340. The four support pieces 350 and underneath support 380 are not shown in the figure. The table top 360 and a game board 370 for playing backgammon are shown fully assembled.

Figure 11:
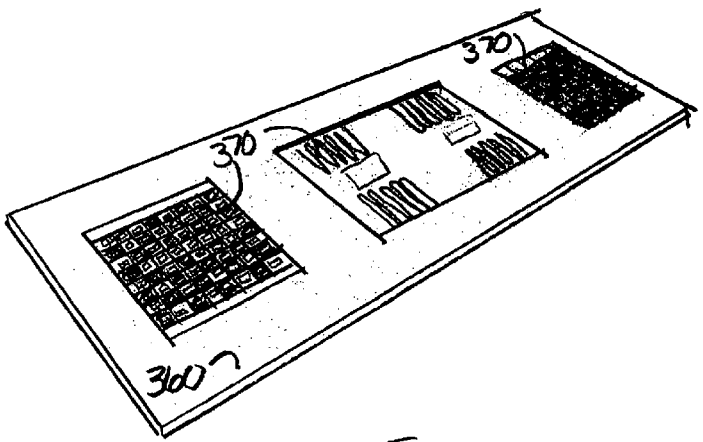
FIG. 11 is a table of another embodiment of the game board/table of the present invention.

FIG. 11 shows a table of the present invention with multiple game boards 370 in a single table 360. In this example game boards for different games are shown. Note that a different table support is shown in this Figure. Such a table configuration would be extremely useful, for example, when the user would want to offer someone a variety of game choices in a waiting room or fast food restaurant or the like.

Figure 12:
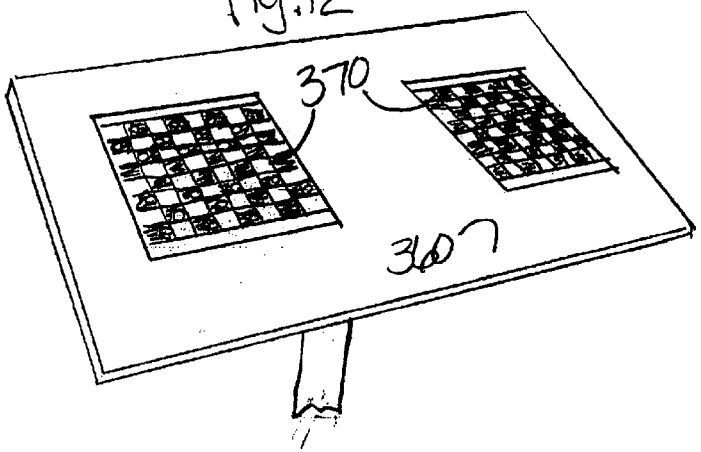
FIG. 12 is a table of yet another embodiment of the game board/table of the present invention.

FIG. 12 shows a table of the present invention with multiple game boards 370 in a single table 360. FIG. 12 shows a table of the present invention with four base pieces 330 are attached to an upright stand 340. The four support pieces 350 and underneath support 380 are not shown in the figure. In this example, game boards for the same game are shown. Such a table would be extremely useful in a tournament type setting where multiple players might be playing the same game.

Figure 13:
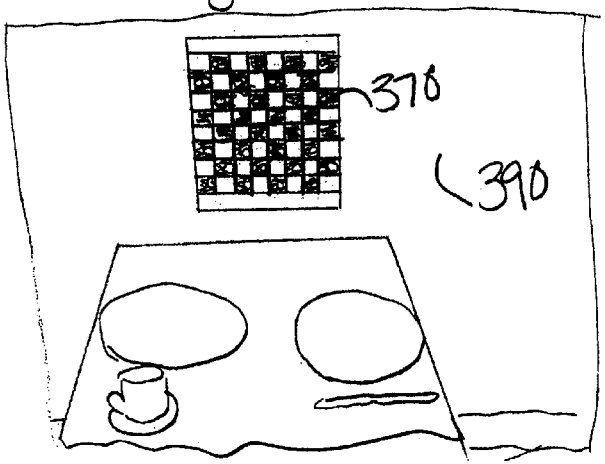
FIG. 13 is a view of a game board of the present invention integrated into a wall.

FIG. 13 shows a game board 370 integrated into a wall 390 next to a dining area. The game board may be hung onto a wall using any standard picture hanging means or the game board may be embedded into the wall using the means described above in the present invention.

It can now be appreciated that the game boards of the present invention may be embedded into any size or shape table made of any construction. The game boards may be integrated into walls for example of a home, restaurant, office or the like. The game boards may also be integrated into any permanent structure such as the wall or seat back of a train, plane or automobile.

The top surface of each of the game boards described above will now be discussed in further detail. In particular, the term "top surface" is used throughout the invention to describe the article that includes the cutouts, is attached to side walls, and the rods, with rollers fitted thereupon, running crossways under the top surface. It can be appreciated that this article called "top surface" has two sides and a thickness to it. When a player looks at the game board, they see the top of the "top surface" and access the rollers through the cutouts on the top of the "top surface". The "top surface" has a side opposite the side seen by the player. This opposite side is oriented downward towards the floor and/or towards an interior created by the assembly of the "top surface" with four side walls. It can also be appreciated that each cutout of the "top surface" has four sides. The rollers that run crossways under the "top surface" form an axis about which the rollers rotate. This rotation results in two opposing sides of each cutout coming in close proximity with the roller.

Figure 14:
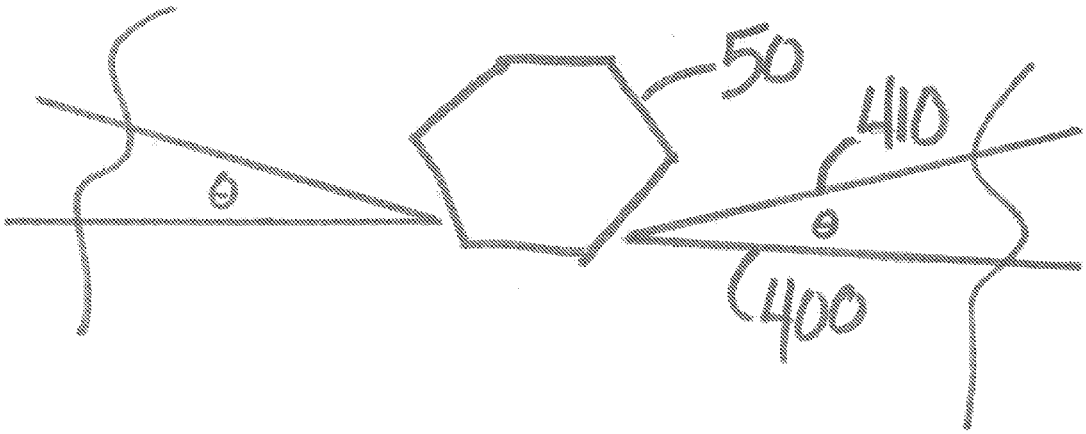
FIG. 14 is a cross-sectional view of a single cutout with a six sided roller.

Referring to specifically to the side of the "top surface" that is opposite the side seen by the player; a variation of the "top surface" will now be described. In particular, the side of the "top surface" facing the interior is adjusted to ease the movement of the rollers. In particular the two opposing sides of each cutout that come in closest proximity with the sides of the rollers as they rotate are angled in such a way as to aid in the movement of the roller. Referring now to FIG. 14, the modification is shown and described. In particular, a roller 50 is accessible to a player from the cutouts on the top of the "top surface" 400. The opposite side 410 of the "top surface", oriented towards an interior created by the assembly of the "top surface" with four side walls, is angled at an angle, θ, to aid in the rotation of the roller.

In use it therefore, the present invention encompasses embodiments wherein the top surface has on one side a game surface, the game surface having cutouts, each cutout have four sides. The top surface would also have a side opposite the game surface side. On this opposite side of the top surface, opposing sides of each cutout would be angled so as to aid in roller movement.

It can be appreciated that the angle may be varied by the user as needed depending upon the size, shape, and number of sides on the roller. The angle may be made by any appropriate means. The angles at each end of the cutout may be the same or different.

Figure 15:
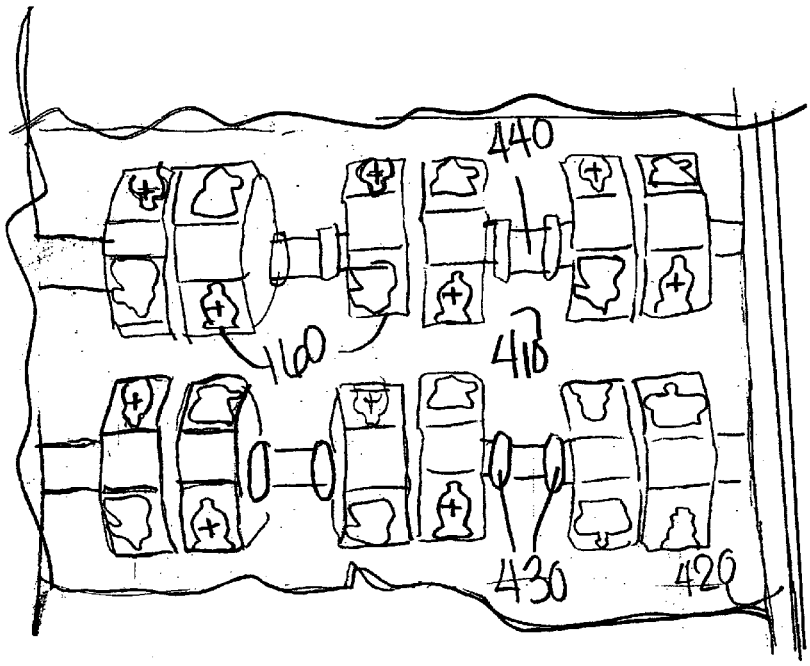
FIG. 15 is a bottom view of another embodiment of the gaming apparatus using integrated rollers for game pieces constructed in accordance with the principles of the present invention for playing chess.

Another type of stop material will now be described. Referring to FIG. 15, another game board for playing chess is described. The "top surface" has a side opposite the side seen by the player. This opposite side of the "top surface" is shown 410, it is oriented towards an interior created by the assembly of the "top surface" with four side walls 420. It is preferred that the rollers 160 do not rotate freely but only rotate when a player applies pressure to the roller 160 with a fingertip from the top of the "top surface". A fitting 430 can be fitted onto the rod 440 adjacent to each roller 160. This fitting may be made of plastic or a plastic tubing that fits snugly onto the rod. To this end, the fitting functions so that the roller 160 is easily stopped when the roller 160 reaches the position desired by the player.

Figure 16:
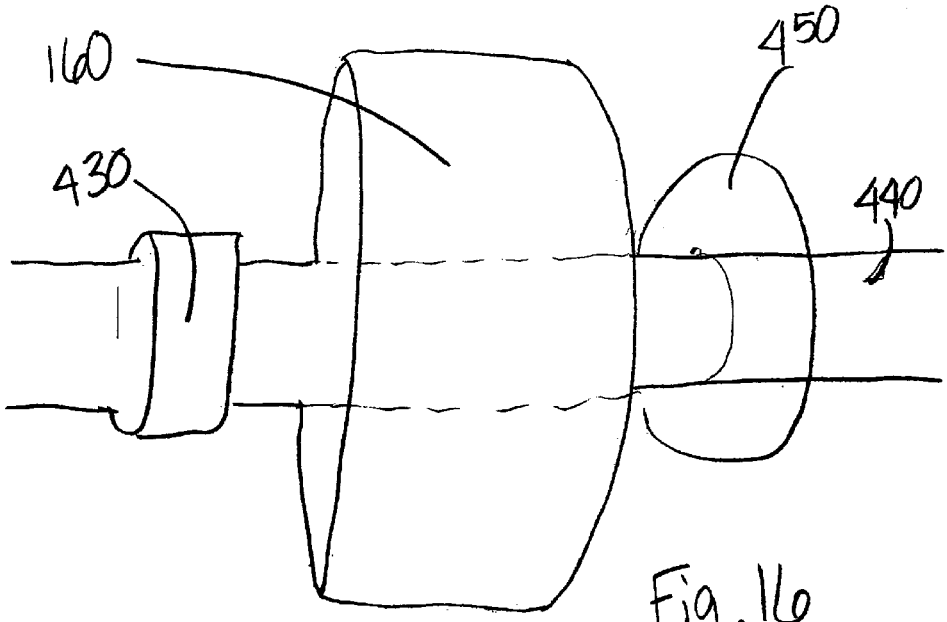
FIG. 16 is an exploded view of the rod/roller combination of the present invention.

FIG. 16 shows how the rod/rollers may be assembled with the above described fitting. The figure shows a fitting 430 on a rod 440. In this Figure, for illustrative purposes only, a non-sided roller 160 is shown. The fitting may include a collar to ease the roller snugly against the fitting. In this Figure, only one roller is shown. Since two rollers will be present in each cutout of the game board, a disc 450 may be placed adjacent to the first roller prior to placement of the second roller onto the rod to reduce friction between the rollers and ensure that the rollers will roll independent of each other.

It can be appreciated that the above stop material may be applied to any game board of the present invention. It can further be appreciated that the fitting and disc described above may be made of any appropriate material and design provided the function of optimizing roller rotation is achieved.

The present invention maybe adapted to play to any games rules that use chess or checker or backgammon pieces. The game board may be adapted for different colors, number, or shape of game play surface. The present invention may be used to make a game board with integrated game pieces for games such as Othello™, Chinese checkers, Mastermind, or any other game board/game piece combination.

The present invention maybe adapted to game boards used to play a game by more than two players. For example, a game board using the concepts of the present invention can be developed for a game played with four players such as Pente or Parcheesi or the like. A game that requires game pieces in four colors for four players may be provided on rods placed underneath a game board as described above for checkers, chess or backgammon.

It can now be appreciated that the present invention may include a travel case for the game apparatus of the present invention. The travel case may be a separate entity into which the game apparatus will fit, or any portion of the game apparatus, such as the top, side walls, bottom or any combination thereof may be modified to include a handle or carrying means.

It can now be appreciated that the present invention encompasses any game apparatus having a top and side walls connected to the top, the top having a game surface, the game surface having cutouts; rods running under the game surface and attached to at least one of the side walls; multisided rollers fitting on each of the rods, the rollers accessible to a player through the cutouts in the game surface, the rollers include on each side of the roller different colors or shapes to represent different game pieces. The cutouts within the game surface are in the field of play. Further the present invention provides for a game apparatus comprising a stop material to interact with the multisided rollers and prevent the rollers from freely rotating.

The present invention, as demonstrated by numerous embodiments, is extremely versatile and provides an apparatus to play any game that uses a game board and game pieces that move upon the game board. The present invention essentially comprises a top and side walls connected to the top, the top having a game surface with cutouts in the game surface, the game apparatus also including rods running under the game surface and attached to the side walls with multisided rollers fitting on each of the rods. The rollers are accessible to a player through the cutouts in the game surface and the rollers including, on each side of the roller, different colors or shapes to represent different game pieces. The basic invention can be applied to checkers, chess, backgammon and numerous other games as encompassed by the present invention.

It is appreciated the rollers of the present invention are multisided. The number of sides on each roller and as well as the number of rollers on a rod can be varied depending on the nature of the game to be played. The number of sides on each roller is determined for the number of representations of game pieces needed to play a game. For instance, more representations are needed to play chess than checkers therefore a roller with more sides is used. Further, more representations of checkers are needed than other games because the rollers of the game apparatus of the present invention also include a "kinged" game piece (equivalent to two game pieces on a single spot).

It is appreciated that the present invention, while describe some games that have four sides also encompasses game boards of different shapes. For example, a triangular, circular or star shape boards may also be used in the game apparatuses of the present invention. The game boards of the present invention may by made of any material, and of any color.

It is appreciated that the rods may need to be supported. The present invention encompasses any support for the rods. The support may be positioned anywhere to best support the rod and be of any shape. It may be secured to the walls, top or bottom of the game apparatus. Each rod may have its own support or a single support that can accommodate all of the rods of the game apparatus are encompassed. The support may be made of any material. More than one support may be used as needed.

It is appreciated that the length and width of the game board may be varied as desired by the user. For example, if the addition of a scoring mechanism is desired, the top surface may be enlarged and include such a mechanism. The scoring mechanism may be an abacus, a digital calculator device or the like.

It is appreciated that the rods that hold the rollers may be varied as needed. For example, the rods are provided underneath the top surface of the game board. It is necessary that the rods are underneath the field of play of the game board so that the player can access the rollers placed upon the rods from the top surface of the game board. It is not required that the rods are in contact with the side walls of the game apparatus. Another set of side walls may be added. It can now be appreciated that the side walls that connect to the rods are not necessarily the side walls that form the edges of the game apparatus. That is, a game apparatus may include more than one set of side walls, one that forms the shape of the game apparatus and another within the game apparatus that connects to the rods. In another embodiment, the side walls to which the rollers are attached are not in direct contact with the top but sufficiently close so that rollers placed on the rod may be accessed by the players from the top of the game board. The present invention also encompasses an embodiment of the game apparatus where a system independent of the side walls is included within the box formed by the game surface and side walls is used to support and secure the rods.

The present invention has the following advantages. This game apparatus reduces a standard game of checkers from 25 pieces to 1 piece. For all game board and game piece combinations of the present invention the number of pieces necessary to play a complete game are reduced to one. The present invention allows the game to be played without parents worrying that a small child will choke on a piece or that numerous pieces will be lost. This also allows for playing of the game in awkward places or positions, on unstable surfaces or to even move the game without fear of pieces falling off or getting lost. It is a great travel game. This game does not require power, and can be utilized in places where it might get wet or be exposed to the elements. It is a safe way to teach classic board games to toddlers. When the game apparatus of the present invention is modified to play chess, the present game apparatus reduces 33 pieces of a standard chess set down to 1 and has all the advantages of checkers version of the game apparatus. Chess players will find playing without pieces intriguing. The basic concept of the game apparatus of the present invention with integrated rollers containing game pieces may also be adapted to other games.

While a preferred embodiment of the gaming apparatus with integrated game pieces has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, fiberglass, marble, cardboard may be used instead of the plastic described. And although a novel gaming apparatus for playing chess, checkers and backgammon has been described, it should be appreciated that the gaming apparatus with attached game pieces herein described is also suitable for a wide variety of board games with movable game pieces instead of those described. Furthermore, a wide variety of thicknesses of materials or basic shape and size of the game board may be varied.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A table with integrated game board comprising:

a table top with a cutout complimentary to a game board unit;

at least one support for the game board unit and table combination that is attached underneath the table top game board combination and also attached to one end of at least one pedestal or upright stand;

at least one pedestal or upright stand that is attached at one end to the at least one support for the table top game board combination and attached to at least one table base at the opposite end;

at least one table base attached to at least one pedestal or upright stand, forming a bottom; and a game board unit having:

a top surface haying cutouts;

side walls connected to each other and to the top surface, rods running under the top surface and attached to at least one side wall;

multisided rollers fitting on each of the rods wherein, two rollers are accessible to a player through each cutout from the top surface.

2. The table of claim 1 wherein the game board unit further comprises:

sixteen three or six sided rollers fitting on each of the rods;

one roller in each cutout having the images of checker pieces in a first color; and a second roller in each cutout having the images of checker pieces in a second color.

3. The table of claim 1, wherein a game board unit for playing backgammon further comprises:

two rectangular halves, each with twelve play sections, each play section including eight cutouts, and a counter for keeping score.

4. The table of claim 1 wherein the table top includes cutouts for more than one game board units and the table include game boards units for more than one game.

5. A table with integrated game board comprising:

a table top with a cutout complimentary to a e board unit;

at least one support for the game board unit and table combination that is attached underneath the table top game board combination and also attached to one end of at least one pedestal or upright stand;

at least one pedestal or upright stand that is attached at one end to the at least one support for the table to game board combination and attached to at least one table base at the opposite end;

at least one table base attached to at least one pedestal or upright stand, forming a bottom; and a game board unit having:

a top surface haying cutouts;

side walls connected to each other and to the top surface;

rods running under the top surface and attached to at least one side wall;

multisided rollers fitting on each of the rods wherein, two rollers are accessible to a player through each cut; wherein one roller in each cutout having the images of chess pieces in a first chess piece color; and a second roller in each cutout having the images of chess pieces in a second chess piece color.

* * * * *